US006546970B2

(12) United States Patent
Gatteschi

(10) Patent No.: US 6,546,970 B2
(45) Date of Patent: Apr. 15, 2003

(54) NOZZLE FOR FILLING OPERATIONS WITH TWO LIQUID AND/OR GAS PRODUCTS FOR FILLER MACHINES

(75) Inventor: Carlotta Gatteschi, Parma (IT)

(73) Assignee: OCME S.r.l, Parma (IT)

( * ) Notice: Subject to any disclaimer, the term of this patent is extended or adjusted under 35 U.S.C. 154(b) by 0 days.

(21) Appl. No.: 10/040,285

(22) Filed: Nov. 7, 2001

(65) Prior Publication Data

US 2002/0108676 A1 Aug. 15, 2002

(30) Foreign Application Priority Data

Nov. 17, 2000 (IT) ..... MI00A2482

(51) Int. Cl.[7] ..... B65B 1/04

(52) U.S. Cl. ..... 141/106; 141/105; 141/301; 141/302; 141/100

(58) Field of Search ..... 141/106, 105, 141/104, 100, 301, 302; 222/135, 137, 145.1, 144.5, 509, 514; 137/637.2, 606

(56) References Cited

U.S. PATENT DOCUMENTS 2,750,077 A * 6/1956 Lurie ..... 222/135
3,267,971 A * 8/1966 Mueller ..... 141/105
3,415,294 A * 12/1968 Kelly ..... 141/286
3,881,529 A * 5/1975 Mannara ..... 141/100
4,117,955 A * 10/1978 Sokolow ..... 222/144.5
5,030,076 A * 7/1991 Ebenhofer et al. ..... 425/130
5,097,993 A * 3/1992 Davis ..... 222/509
5,125,817 A * 6/1992 Yamachika ..... 425/130
5,167,896 A * 12/1992 Hirota et al. ..... 264/255
5,220,946 A * 6/1993 Murao et al. ..... 141/302
5,228,604 A * 7/1993 Zanini et al. ..... 222/509
5,292,068 A * 3/1994 Raterman et al. ..... 239/11
5,573,048 A * 11/1996 Moon et al. ..... 141/301
5,975,163 A * 11/1999 Gianfranco ..... 141/302
6,251,326 B1 * 6/2001 Siano et al. ..... 264/328.8
6,305,441 B1 * 10/2001 Till ..... 141/104

* cited by examiner

*Primary Examiner*—Gregory Huson
*Assistant Examiner*—Khoa Huynh
(74) *Attorney, Agent, or Firm*—Hedman & Costigan, P.C.

(57) ABSTRACT

A nozzle for filling operations with two liquid and/or gas products for filler machines which can be aligned with a mouth of a container to be filled comprising a first fixed shutter element (21) and a first outlet opening (18) in a moveable hollow body **(16, 16*a*), wherein the hollow body (16, 16*a*) is associated at the top with a first feeding system (12) for a first product to be dispensed into the container and the hollow body (16, 16*a*) can be moved between at least one engagement position, in which the first opening (18) is closed by the first shutter element (21), and a disengagement position, in which such a first opening (18) is opened and the first product flows into the container, moreover said first shutter element (21) being at least partially hollow (19) so as to be equipped on one side with a second outlet opening (38), coaxial with said first opening (18) in said hollow body (16, 16*a*), and on the other side with a second feeding system (11) for a second product to dispense into the container, wherein a second shutter element (41) is foreseen coaxial with said first hollow shutter element (21) which can be moved between at least one engagement position, wherein it closes the second outlet opening (38), and a disengagement position wherein it opens such a second opening (38) and the second product flows into the container, being foreseen control elements (33, 44) which are independent both for the movement of the hollow body (16, 16*a*) and of the second shutter (41)** depending upon the type of filling of the container which is selected.

10 Claims, 4 Drawing Sheets

Figure 1:
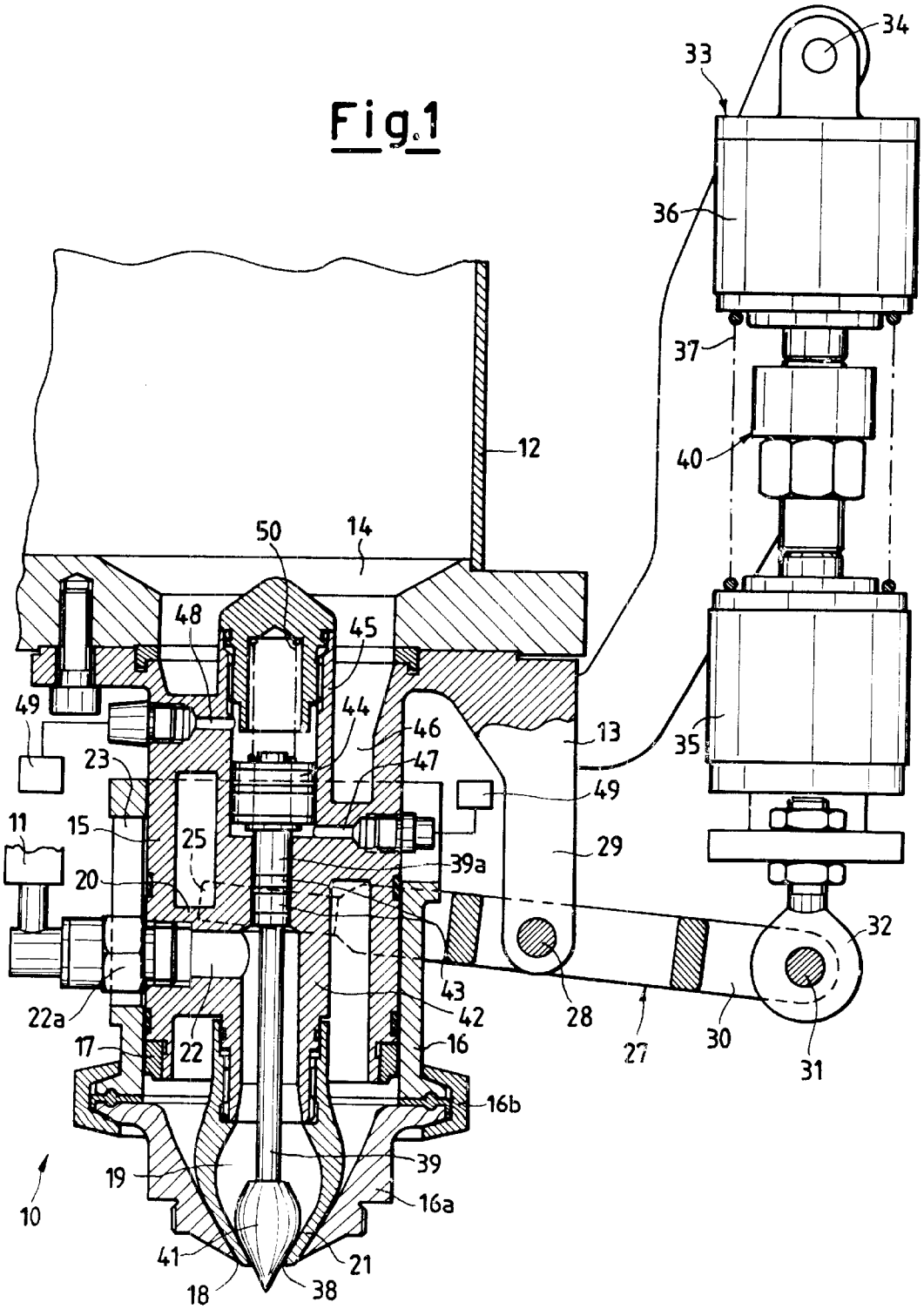

NOZZLE FOR FILLING OPERATIONS WITH TWO LIQUID AND/OR GAS PRODUCTS FOR FILLER MACHINES

The present invention refers to a nozzle for filling operations with two liquid and/or gas products for filler machines, in particular both static and rotary filler machines.

It is well known that in the field of machines for filling containers with liquids, of the static, rotary or swivel type, in the filler head or in each filler head, in particular in the filling nozzle, devices capable of stopping or intercepting the flow of liquid when the measuring head is not filling anything up or has finished its work, have been realised. Moreover, devices which allow the flow of liquid to be regulated during the filling of the container have been devised.

To the best of the Applicant's knowledge, these functions are usually obtained through the provision of a plugging shutter capable of translating backwards and forwards which, inserting into the nozzle's outlet, blocks the flow of liquid.

Moreover, the plugging shutter, as it moves away from the outlet, frees the passage and can allow the liquid to escape at a greater flow rate the further the pin is from the outlet.

Accordingly, it can be seen how in nozzles thus realised there is a fixed outer part, in general with respect to the machine's feeding system, which has the outlet for the liquid and a plugging shutter which is mobile, through an opening, which regulates and intercepts the flow by inserting into the outlet for the liquid towards the container to be filled.

This arrangement of parts has the great limitation that it only allows one single product to be dispensed, for example a liquid, at any one time. In such a way if two liquids or a liquid and a gas or other need to be dispensed inside a container, one has to foresee two successive stations for the successive and separate feeding of them in the same container.

There is, therefore, a double arrangement of a pair of nozzles, each of which is only dedicated to a single product of the two to be fed inside the container.

All this carries high installation costs for the double presence of dispensing groups and of as many control groups, as well as the need for transportation between the first and the second nozzle for supplying the two products to the container.

Moreover, the very fitting of two nozzles in succession requires long filling times for placing the two products in the single container.

A purpose of the present invention is that of realising a nozzle for filling operations with two liquid and/or gas products for filler machines which solves all of the technical problems outlined previously.

Another purpose is that of simplifying down to the minimum the apparatus and the devices connected to the interception and the control of the nozzle for filling a single container with liquid and/or gas products.

Yet another purpose is that of easing, improving and making as fast as possible the operations connected to the filling of a container with two liquid and/or gas products.

These and other purposes according to the present invention are achieved be realising a nozzle for filling with two liquid and/or gas products for filler machines according to claim 1.

Figure 2:
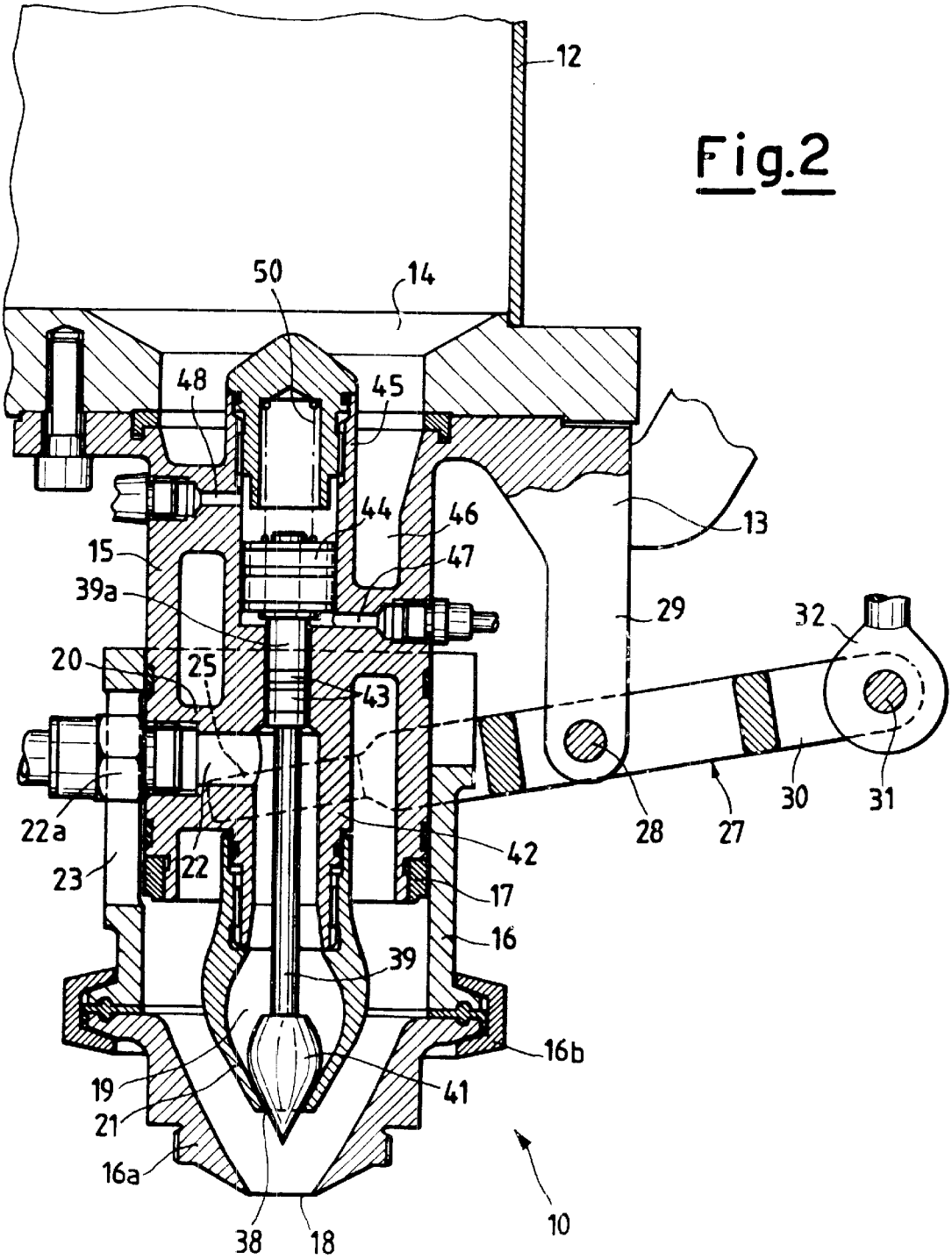
Figure 3:
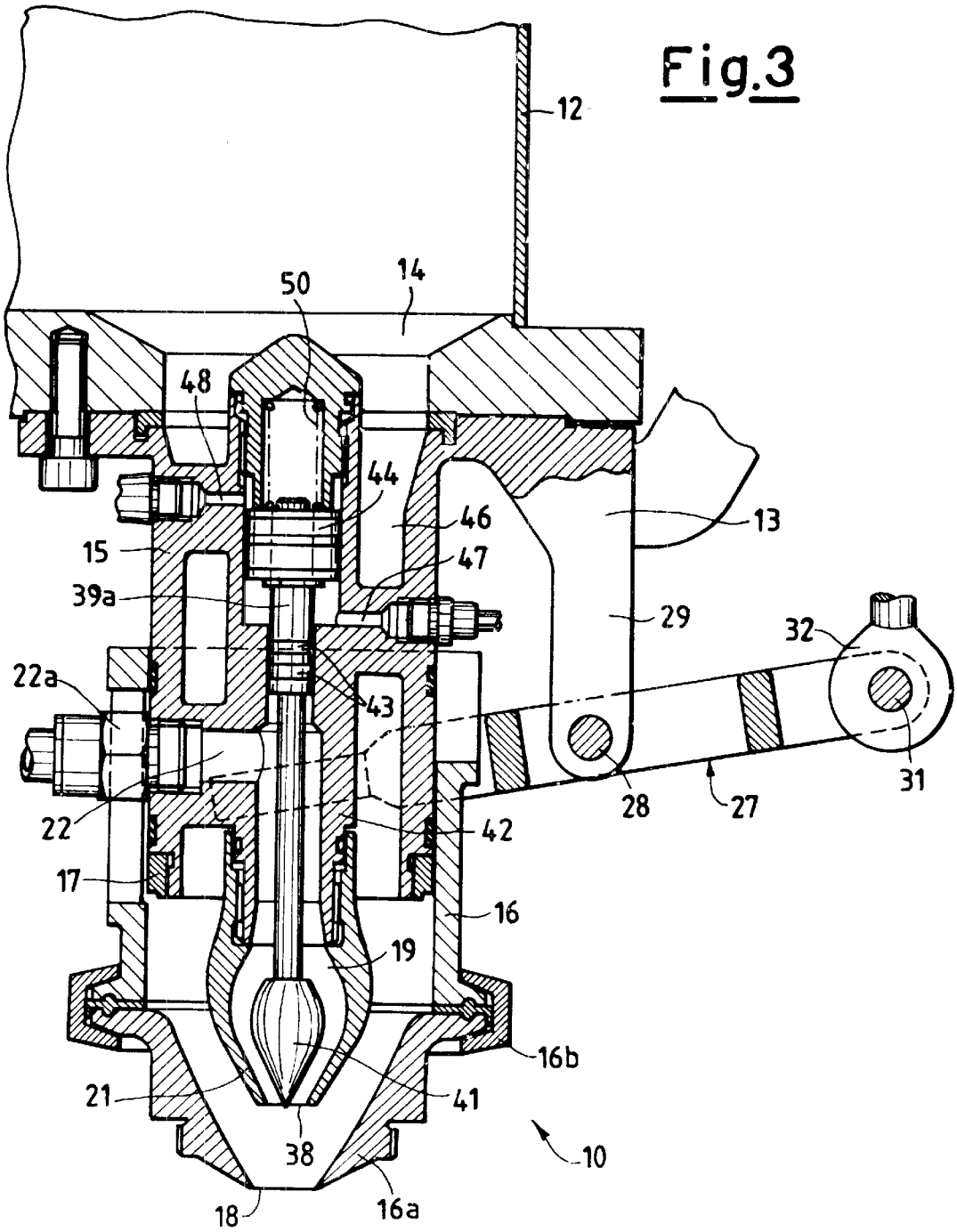
Figure 4:
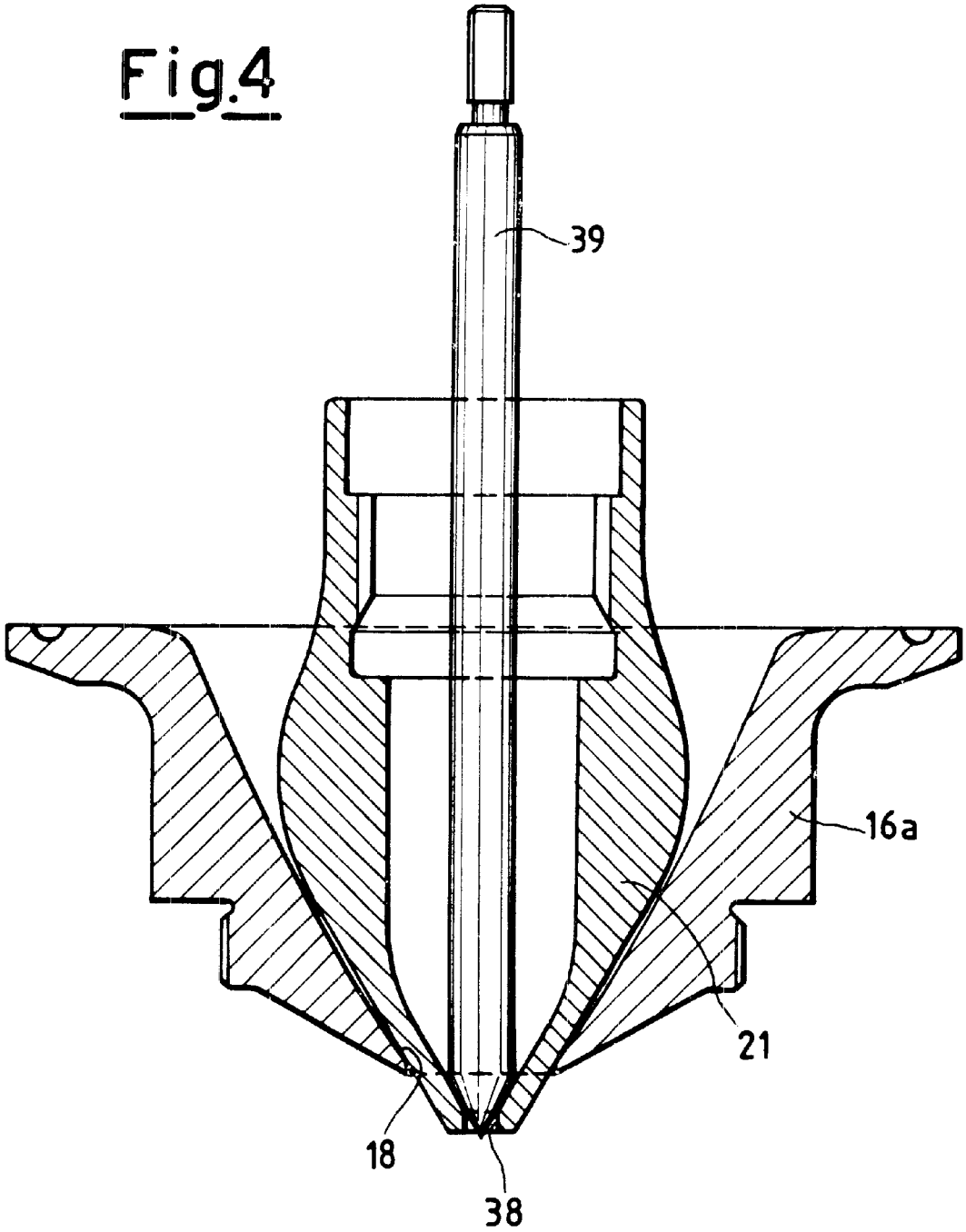

The characteristics and the advantages of a nozzle for filling operations with two liquid and/or gas products for filler machines according to the present invention will become clearer from the following description, given as an example and not for limiting purposes, referring to the attached schematic drawings wherein:

FIG. 1 is a partial section view of a nozzle for filling operations with two liquid and/or gas products for filler machines in a completely closed position, FIG. 2 is a section view which is the same as that of FIG. 1 with the nozzle in an intermediate opening position, FIG. 3 is a section view which is the same as that of FIG. 1 with the nozzle in a maximum opening position, FIG. 4 is a section view of the only end part of a different embodiment of the nozzle's shutter, With reference to the figures, a nozzle for filling operations with two liquid and/or gas products for filler machines is shown, indicated as a whole with 10, and is associated with a first 12 and with a second 11 system for feeding identical or different products, in the form of a liquid and/or a gas. The nozzle 10 either alone or acting together with many similar units can be arranged on a filler machine of the fixed or rotary swivel type.

The feeding systems 12 and 11, for example reservoirs, are arranged with one above and one along the side of a support structure 13 for carrying the nozzle 10. A base opening 14 of the first feeding system 12 is aligned with a mouth 15, of the tubular type, formed in the support structure 13 and facing downwards so as to insert into a hollow body 16 or short duct which constitutes the most outer part of the nozzle 10.

The hollow body 16 also has a tubular form and is suitable for at least partially surrounding the mouth 15 to form a seal through a gasket 17, attached to the outside of the mouth 15 and capable of sliding on the hollow body 16. The presence of the gasket guarantees the seal against the leaking of the liquid and/or gas, also in the case in which the machine's first feeding system 12 is pressurised.

The hollow body 16 has a first opening or mouth 18 for the outlet or discharge of the first liquid which can receive additional systems for conveying and slowing the fluid, such as nets or other which are not shown in the figures, for example screwed or locked in another way on the hollow body 16. An end portion 16*a,* which can be connected with the junction 16*b* which allows the size of the opening 18 to be varied, forms part of the body 16.

A first shutter element 21 or outer shutter, for example ogive-shaped, is fixedly connected with the mouth 15 or with the support structure 13, supported by a spoke 20 radially turned towards the inside of the mouth 15. Such a spoke 20, for example, is likely to be one of three fins arranged at 120° and supporting the first shutter element 21.

In such a spoke 20 is formed a passage 22 which can be used for feeding a second filling product, that being a liquid and/or gas, in an axial hollow chamber 19 of the first shutter element 21 and then in the container (not shown).

Such a passage 22, towards the outside in the form of piping 22*a,* passes into a slot 23, formed vertically on the side surface of the hollow body 16, before being connected to a second system for feeding the second product, liquid or gas, arranged for example in the reservoir, schematised at 11.

It must, moreover, be highlighted that the hollow body 16 can be moved between at least one engagement position, wherein the first opening 18 is engaged and closed by the first shutter element 21, and a disengagement position wherein the first product flows from such an opening 18, of variable size, into the aforementioned container, which is not shown.

For such a movement, outside of the hollow body 16, cylindrical ends 25 of a pair of arms (only partially shown for example in FIG. 1) of a control fork 27 are put on pivoting means or supports, not shown.

The control fork 27 is centrally pivoted at 28 to a downwards extension 29 of the support structure 13 and on the other side extends as a second fork end 30, which is partially shown. This second end 30 is bound to the other end through a pin 31 to an end eyelet 32 of an actuator group or element, wholly indicated with 33.

The actuator element 33 is bound at its other end through a further pin 34 to the support structure 13. The actuator element 33, in the example, comprises a pair of pneumatic cylinders 35 and 36 whose stroke, individual or combined, allows up to three different degrees of opening of the nozzle to be realised. In such a way it is possible to realise the mass rough filling of the container, through the two cylinders 35 and 36 actuated simultaneously, and the finishing off of the filling, through cylinder 36 alone.

In the same way, however, such an actuator element 33 can consist of an electric group with a brushless motor, a stepper motor, a proportional pneumatic cylinder or another device. In such a way it is possible to obtain an opening of the nozzle which can be predetermined as one wishes between totally closed and completely open, instead of only the three levels which can be obtained with the two pneumatic cylinders indicated.

In the example shown with pneumatic actuators, a safety spring 37, which has the function of closing the nozzle when there is no compressed air, has been foreseen. In such an eventuality the spring 37 overcomes the pressure of the liquid, the weight of the devices and the friction forces, making the nozzle close. On the other hand, during normal filling the force of the cylinders 35 and 36 obviously has to be enough to also overcome the force applied by the safety spring 37. A screwable regulator device with a nut and counternut, indicated with 40, arranged between the two cylinders 35 and 36 capable of allowing the stroke of the cylinder 36 to be partially reduced is foreseen.

Using electric actuators the closing of the nozzle must be obtained in the case where there is no electric current: for such a purpose capacitors or batteries which supply sufficient energy to carry out the operation are used.

According to the present invention, as already previously stated, the first shutter element 21 comprises the axial hollow chamber 19 inside of it which, at its end facing towards the first opening 18, is also equipped with a second opening 38, coaxial with the first opening 18 and of a smaller size. Moreover, a rod 39 which foresees at its end a second shutter element 41, also ogive-shaped, capable of closing the second opening 38, can be moved in the axial hollow chamber 19. In such a way, for example with both the openings 18 and 38 being round, just like the two shutter elements 21 and 41, annular passages for the two outlet liquid and/or gas products are defined.

The rod 39 has a smaller diameter so as not to clog up the inside of the hollow chamber 19 and to allow the second product, coming from the second product reservoir 11, to pass. The rod 39 extends for an upper portion 39*a* thereof which is arranged in a tubular body 42 in which it slides guided and sealed thanks to the presence of gaskets 43. The rod 39 and 39*a* is connected to a piston 44 arranged in a cylinder 45 which extends upwards from the body of the first shutter element so as to define a channel 46 through the inside of it and between the tubular mouth 15 and the hollow body 16 for the passage of the first product coming from the first reservoir 12.

In the cylinder 45, for example with a dual-effect and fed from a pair of ducts 47 and 48 connected to a pneumatic or hydraulic control circuit, schematised in 49, a spring 50 is also foreseen. This elastic element 50, reacting between the piston 44 and the upper inner surface of the cylinder 45, usually keeps the piston 44, the rod 39*a* and 39 and thus the second shutter element 41 in the closed position for the second opening 38.

Also this double-feeding arrangement 47, 48 of the cylinder 45 with an inner spring 50 allows an opening of the nozzle feeding the second product which can be predetermined as one wishes between totally closed and totally open, instead of a fixed number of only two or three levels, known up to now.

In such a way according to the present invention a nozzle for filling operations with two liquid and/or gas products for filler machines is realised in a single position for filling the container according to steps which are predetermined by the user.

Therefore, hereafter we can give examples of some different types of filling operations which can be carried out with a nozzle according to the invention, which can be defined as a double concentric valve, or rather a double concentric shutter nozzle.

For example a first product, such as a liquid, contained in the reservoir 12 must first be fed in a quantity A to occupy a considerable portion of the container, for example 80%.

For such a purpose, the actuator element 33 is actuated starting from a completely closed position illustrated in FIG. 1.

In such a way, in the position shown in FIG. 1, in which the nozzle is closed by the shutter elements 21 and 41, the control of both of the cylinders 35 and 36 allows the maximum amount of liquid to be fed into the container with mass rough filling. Indeed, in this case the second shutter element 41 is kept in a position closing off the opening 38, whereas the hollow body 16 is moved downwards to disengage from the first shutter element 21 allowing a dispensing of the first liquid from the annular passage which has been created.

The abstraction of a cylinder, the one indicated with 35, allows there to be a limited passage which allows a finishing off filling of the container with the first liquid. The return of the two cylinders 35 and 36 to the position shown in FIG. 1 once again completely closes of the nozzle to the container which has received the quantity A of the first liquid.

Then one must move on to the total filling of the remaining part of the container with the quantity B of 20% of the second product, such as a liquid. For such a purpose steps are taken to actuate the displacement of the piston 44 in the cylinder 45, for example by introducing air. The air introduced by the duct 47 raises the piston, compressing the spring 50, and thus raises the rod 39*a* and 39 pulling the second shutter element 41 with it which frees the second opening 38.

The second product, arriving from the reservoir 11 and passing through the passage 22 and through the piping 22*a*, flows into the hollow chamber 19 of the first shutter element 21 and from there into the underlying container.

This operation continues until the container is filled with the necessary quantity, after which by inserting air through the duct 48, also thanks to the help of the spring 50, the second opening 38 is closed again by the second shutter element 41. This shutter 41 is, indeed, moved into engagement by the downward movement of the piston 44, of the upper portion of the rod 39*a* and of the rod 39, together forming a single piece. Also in this case, by appropriately acting upon the pneumatic control circuit 49 there can be an immediate or else progressive opening. In such a case the closing can also be as one wishes, either progressive or in one of two ways quoted above.

It is clear that this is one of the many examples of use of the nozzle of the invention. Indeed, a simultaneous feeding of the two products can be realised, acting upon both of the actuator elements 33 and 44, 45, and thus carrying out a mixing of the two products, if required.

It should thus be noted how in the nozzle of the present invention the opening and the closing of the flow of the two liquids or gases is realised in the same position, i.e. in a single nozzle, as opposed to that which takes place in prior art nozzles.

The dispensing takes place in both cases according to the axial direction of the nozzle with a saving of space and of costs, avoiding the use of two nozzles, one for each product.

Moreover, the quantity and the filling times of both the liquid or gas products can be chosen as desired. All of these advantages can also be used not just in a fixed position, but also, in the case of rotation, in a filler of the rotary type.

It must be specified that during the opening of the nozzle and the dispensing of the first product which arrives from the upper reservoir, the outlet opening 18 of the first liquid is not fixed, but moves with respect to the feeding system 12 and to the container to be filled (not shown) by an amount which is greater the bigger the size of the opening which is left open by the nozzle's shutter.

FIG. 4 shows how the second shutter element 41 can have a pointed form extending from the rod 39 thanks to the fact that the first shutter element 21 has an extremely pointed form with a restricted outlet opening 38. Such an extension leads to a lower dispensing of the second product. It is possible to have a combination as desired of the diameters of the openings 18 and 38, replacing the end elements 16*a*, 21 and 41.

The presence of the gaskets 17 and 43 interposed between the fixed inner mouth 15 and the mobile outer part 16 as well as between the extension of the rod 39*a* and the fixed tubular body 42 inside the mouth 15 is such as to guarantee the seal against the leaking of liquids and/or gases, also in the case in which the feeding systems of the machine are pressurised.

The conception of this nozzle allows there to be, as well as a feeding of two products, also a feeding without foam due the differing liquid levels and possibly a sucking in through the opening 18, transforming the feeding system 12 into a sucking system.

The advantages of a nozzle according to the present invention are therefore clear.

The nozzle of the present invention, thus conceived, is susceptible to numerous modifications and variants, all covered by the same invention.

Moreover, in its embodiment the materials used, as well as their sizes and the components, can be whatever according to the technical requirements.

What is claimed is:

1. A filling nozzle for filling operations with two liquid and/or gas products for filler machines which are alignable with a mouth of a container to be filled with two products, liquids and/or gases, said filler nozzle comprising a first fixed shutter element (21) and a first outlet opening (18) in a hollow body (16, 16*a*) is associated at the top with a first feeding system (12) for a first product to be dispensed into the container, the hollow body (16, 16*a*) being moveable in an upwardly direction by an actuator element (23) between an engagement position, in which the first opening (18) is closed by the first shutter element (21), and in a downwardly direction to a disengagement position, in which at least the first opening (18) is opened and the first product flows into the container, said first shutter element (21) being at least partially hollow (19) and being equipped on a first side with a second outlet opening (38), coaxial with said first opening (18) in said hollow body (16, 16*a*), and on a second opposite side with a second feeding system (11) for a second product to dispense into the container, inside and coaxial with said first hollow shutter element (21) is provided with a second shutter element (41) which is moveable by an actuator element (44) to an engagement position, in which it closes the second outlet opening (38), and a disengagement position in which the second outlet opening (38) is open and the second product flows into the container wherein the actuator elements (33, 44) are activated independently of one another for the movement of the hollow body (16, 16*a*) and of the second shutter (41) depending upon the type of container which is being filled.

2. The filling nozzle according to claim 1, wherein said two shutter elements (21, 41) are coaxial and slide one (41) in respect to the other (21) to define said second annular opening (38) for the dispensing of said liquid or gas.

3. The filling nozzle according to claim 1, wherein said hollow body (16) is carried through pins from the control fork (27) centrally pivoted (28) to said support structure (13) and hinged (31) to the other end of said control elements (33).

4. The filling nozzle according to claim 1 or 3, wherein said control elements (33) comprise a pair of pneumatic cylinders (35, 36) whose stroke, individually or combined, allows up to three different degrees of opening of said first opening (18) of said nozzle.

5. The filling nozzle according to claim 4, wherein a screwable regulator device with a nut and a counternut (40), are arranged between said two cylinders (35, 36) capable of allowing the stroke of the cylinder (36) to be partially reduced.

6. The filling nozzle according to claim 4, wherein between said two cylinders (35, 36) is interposed a safety spring (37) which in a resting state determines the displacement of said hollow body (16) on said first shutter element (21).

7. The filling nozzle according to claim 1 or 3, wherein said control elements (33) comprise an electric group with a brushless motor, stepper motor or proportional pneumatic motor which provide an annular opening with a movement of said hollow body (16) with respect to said first shutter element (21) in any position which are predetermined between completely closed and completely open.

8. The filling nozzle according to claim 1, wherein said first shutter element (21) has a hollow chamber (19) which extends into a passage (22) and in a piping (22*a*) which is arranged in a slot (23) formed on the side of said hollow body (16).

9. The filling nozzle according to claim 1, wherein said second shutter element (41) is carried by a rod (39, 39*a*) driven by a piston (44) of a cylinder (45), which is arranged above said first shutter element (21) in a fixed mouth (15) arranged in said hollow body (16) and can be moved at least between said two positions.

10. The filling nozzle according to claim 9, wherein said cylinder (45) is of the dual-effect type with an elastic element (50) which usually keeps said second shutter element (41) in a position to close off said opening (38).

* * * * *